US008905160B1

(12) United States Patent
Verzilli et al.

(10) Patent No.: US 8,905,160 B1
(45) Date of Patent: Dec. 9, 2014

(54) DRILL PIPE HANDLING ASSEMBLY

(75) Inventors: Claudio Verzilli, Knoxville, TN (US); Justin Wheeler, Knoxville, TN (US); Tim Smith, Lenoir City, TN (US)

(73) Assignee: Astec Industries, Inc., Chattanooga, TN (US)

( * ) Notice: Subject to any disclaimer, the term of this patent is extended or adjusted under 35 U.S.C. 154(b) by 1143 days.

(21) Appl. No.: 12/584,318

(22) Filed: Sep. 3, 2009

(51) Int. Cl.
*E21B 19/00* (2006.01)

(52) U.S. Cl.
USPC ..... 175/85; 175/52; 175/203

(58) Field of Classification Search
CPC ..... E21B 7/00; E21B 7/003; E21B 7/02; E21B 3/00; E21B 19/00; E21B 19/08; E21B 19/083; E21B 19/14; E21B 19/15; E21B 19/20; E21B 19/155
USPC ..... 175/52, 85, 203
See application file for complete search history.

(56) References Cited

U.S. PATENT DOCUMENTS

| | | | | |
|---|---|---|---|---|
| 3,145,786 | A | 8/1964 | O'Neill et al. | |
| 3,734,209 | A | 5/1973 | Haisch et al. | |
| 4,347,028 | A | 8/1982 | Dugan | |
| 4,403,897 | A | 9/1983 | Willis | |
| 4,547,110 | A | 10/1985 | Davidson | |
| 4,604,724 | A | 8/1986 | Shaginian et al. | |
| 4,708,581 | A | 11/1987 | Adair | |
| 4,834,604 | A | 5/1989 | Brittain et al. | |
| 4,951,759 | A | 8/1990 | Richardson | |
| 5,607,280 | A * | 3/1997 | Rozendaal | 414/745.7 |
| 5,931,238 | A | 8/1999 | Gilmore et al. | |
| 6,179,065 | B1 * | 1/2001 | Payne et al. | 175/24 |
| 6,220,807 | B1 | 4/2001 | Sorokan | |
| 6,298,927 | B1 | 10/2001 | Back | |
| 6,311,788 | B1 | 11/2001 | Weixler | |
| 6,332,502 | B1 * | 12/2001 | Mills et al. | 175/52 |
| 6,474,932 | B1 * | 11/2002 | Rush | 414/798.1 |
| 6,533,046 | B2 * | 3/2003 | Mills et al. | 175/52 |
| 6,637,525 | B2 * | 10/2003 | Watanabe et al. | 175/52 |
| 7,240,742 | B2 * | 7/2007 | Sewell et al. | 175/52 |
| 7,469,749 | B2 | 12/2008 | Folk | |
| 7,473,065 | B2 * | 1/2009 | Wells | 414/22.57 |
| 7,544,036 | B1 * | 6/2009 | Randall et al. | 414/746.4 |
| 7,600,584 | B2 * | 10/2009 | Sewell et al. | 175/52 |
| 8,240,968 | B2 * | 8/2012 | Hopkins et al. | 414/22.55 |
| 2003/0170095 | A1 * | 9/2003 | Slettedal | 414/22.59 |
| 2007/0031215 | A1 | 2/2007 | Belik | |
| 2007/0092358 | A1 | 4/2007 | Innes et al. | |
| 2008/0296063 | A1 | 12/2008 | Marshman | |

* cited by examiner

*Primary Examiner* — Jennifer H Gay
*Assistant Examiner* — Elizabeth Gitlin
(74) *Attorney, Agent, or Firm* — Chambliss, Bahner & Stophel, P.C.

(57) ABSTRACT

An assembly for handling drill pipes includes a basket for drill pipes arranged in rows and columns, and a support table that has a drill pipe receiver. The support table moves laterally with respect to the drill pipe basket between a plurality of column alignment positions and an external position which locates the drill pipe receiver laterally outside of the basket. The support table also moves between the plurality of column alignment positions and the external position. The drill pipe handling assembly also includes a drill pipe elevator assembly and a loader arm assembly comprising a loader arm having a pipe gripper. The loader arm moves between a table alignment position in which the pipe gripper may grab or release a drill pipe when the support table is in the external position and a drilling alignment position in which the pipe gripper may grab or release a drill pipe.

20 Claims, 7 Drawing Sheets

DRILL PIPE HANDLING ASSEMBLY

FIELD OF THE INVENTION

The present invention relates generally to drilling machines such as are used, for example, in drilling oil and water wells. More particularly, the invention relates to a handling assembly that is used in transferring drill pipes between a storage magazine and a drill string.

BACKGROUND OF THE INVENTION

In drilling wells for water or oil, a rotary bit is typically powered from above the surface by a suitable rotary drill head. The bit is carried on the lower end of a drill string comprised of a number of pipe sections that are joined together, usually by threaded engagement. A mud slurry is typically pumped downwardly through the drill string in order to carry cuttings from the drill bit upwardly around the pipe surface and out of the drill hole.

Frequently, drill rigs of this type are mounted on trucks or tracked vehicles so that they may be driven to the drill site. Such vehicles typically have a drilling mast that is pivotally mounted on the vehicle chassis so that it may be pivoted from a generally horizontal travel position to a generally vertical drilling position. The drill head is mounted on the mast and is adapted to rotate the drill string as it pushes it downwardly. Because it may be necessary to drill to a depth of hundreds or thousands of feet, the length of the drill string must be increased as drilling proceeds. Each time the drill head reaches the lower end of the mast, it must be disconnected from the drill string and raised to the upper end of the mast so that another drill pipe may be added to the drill string. Generally, a plurality of individual drill pipes, each of which may be twenty feet long, are stored in a pipe storage magazine on or near the drill rig, and a pipe handling assembly is provided to transfer drill pipes from the storage magazine to the drill string. After drilling is completed, the pipe handling assembly is employed to take the drill pipes from the drill string, one by one, and replace them in the storage magazine.

Pipe handling assemblies are described in the following U.S. Pat. No. 3,145,786, No. 3,734,209, No. 4,403,897, No. 4,547,110, No. 4,604,724, No. 4,708,581, No. 4,834,604, No. 4,951,759, No. 5,931,238, No. 6,220,807, No. 6,298,927, No. 6,311,788 and No. 7,469,749, as well as in U.S. patent application publications No. 2007/0031215 and No. 2007/0092358.

Some drill pipe handling systems for use in transferring drill pipes between a storage device and a drill head operate by raising one side of the support surface of a storage device so that drill pipes will roll towards or away from a drill pipe receiver mounted on a pipe gripping arm. Such systems are described and illustrated in U.S. Pat. No. 4,547,110, No. 4,604,724, No. 4,951,759, No. 6,311,788 and No. 7,469,749, and in U.S. patent application publications No. 2007/0031215 and No. 2007/0092358. Other drill pipe handling systems operate by moving a drill pipe transfer mechanism between a generally vertical drilling position and a generally horizontal pipe transfer position. Thus, for example, U.S. Pat. No. 6,298,927 ("the '927 patent") describes a pipe storage and handling system for a drilling rig which includes a pipe control arm assembly that is adapted to move individual drill pipe sections between a horizontal storage rack and a drill head for the vertical drill string. The pipe storage rack is adapted to store pipe sections in three vertical columns. A pipe lifting assembly is provided with an indexing mechanism that includes an indexing cylinder and a pipe saddle assembly. The pipe saddle assembly is adapted to engage the lowermost drill pipe section in the middle column of the pipe storage magazine, so that as the rod of the indexing cylinder is extended, the middle pipe column is raised until the uppermost drill pipe section is positioned in a selection location from which it can be grabbed by the control arm assembly. Then, the rod of the indexing cylinder is extended by an amount equal to the diameter of a pipe section to move another pipe section in the middle column of the magazine into the selection location. This process is repeated until all of the pipe sections are removed from the middle column. A pipe shifting assembly is then employed to shift one of the other pipe columns to the middle column position, so that the pipe sections in this second column can be removed in the same manner as those in the first. Thereafter the shifting assembly is employed to shift the third pipe column to align it with the indexing axis, so that the pipe sections in the third column can be removed. One disadvantage of the assembly of the '927 patent is that it must always remove a drill pipe from the center column in the storage magazine. If fewer than all of the drill pipes in the storage magazine are used, this system will not allow the drill operator to cycle through all of the drill pipes, thereby causing them to wear unequally.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

The steps of any method described herein in connection with the preferred embodiments of the invention can be performed in any suitable order unless otherwise indicated herein, explicitly or by context. The use of any and all examples or exemplary language (e.g., "such as") herein is intended merely to better illuminate the invention and does not pose a limitation on the scope of the invention unless otherwise claimed. Nothing in the specification should be construed as indicating any non-claimed element as essential to the practice of the invention.

Various terms are specifically defined herein. These terms are to be given their broadest possible construction consistent with such definitions, as follows:

As used herein, the term "drill pipe" and similar terms refer to elongate tubes or rods that are used in the drilling or boring of wells and other openings into the earth. "Drill pipes" are commonly, but not necessarily, tubular. They are generally adapted to be joined together, usually by threaded engagement, to form a drill string that carries a drill head. Those having ordinary skill in the art to which the invention relates may use the term "drill pipes" synonymously with the terms drill rods, well casing, production tubing and similar terms:

As used herein, the term "linear actuator" and similar terms refer to an electric, hydraulic or electro-hydraulic device that generates force which is directed in a straight line. One common example of a "linear actuator" is a hydraulic cylinder which includes a cylinder, a piston within the cylinder, and a rod attached to the piston. By increasing the pressure within the cylinder on one side of the piston (over that on the opposite side of the piston), the rod will extend from the cylinder or retract into the cylinder.

SUMMARY OF THE INVENTION

The invention comprises an assembly for handling drill pipes which are adapted to be joined together in a drill string, as well as a drilling machine which includes such an assembly. The drill pipe handling assembly includes a drill pipe basket which is adapted to contain a plurality of drill pipes that are arranged in a plurality of rows and a plurality of columns, and a table assembly that is disposed beneath the drill pipe basket. The table assembly includes a support table having a drill pipe receiver that is adapted to receive a drill pipe and includes a receiver bottom. The support table is adapted to move laterally with respect to the drill pipe basket between a plurality of column alignment positions, each of which locates the drill pipe receiver beneath a column of the drill pipe basket, and an external position which locates the drill pipe receiver laterally outside of the drill pipe basket. The table assembly also includes means for moving the support table between the plurality of column alignment positions and the external position. The drill pipe handling assembly also includes a drill pipe elevator assembly, which includes a drill pipe support that is adapted to support the drill pipes in the drill pipe basket, and means for moving the drill pipe support between an elevated position that is at or above the support table and a lowered position that is at or below the bottom of the drill pipe receiver. The drill pipe handling assembly also includes a loader arm assembly comprising a loader arm having a pipe gripper that is adapted to grab and release a drill pipe, and means for moving the loader arm between a table alignment position in which the pipe gripper may grab or release a drill pipe when the support table is in the external position and a drilling alignment position in which the pipe gripper may grab or release a drill pipe.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which.

DESCRIPTION OF THE PREFERRED EMBODIMENTS OF THE INVENTION

Figure 1:
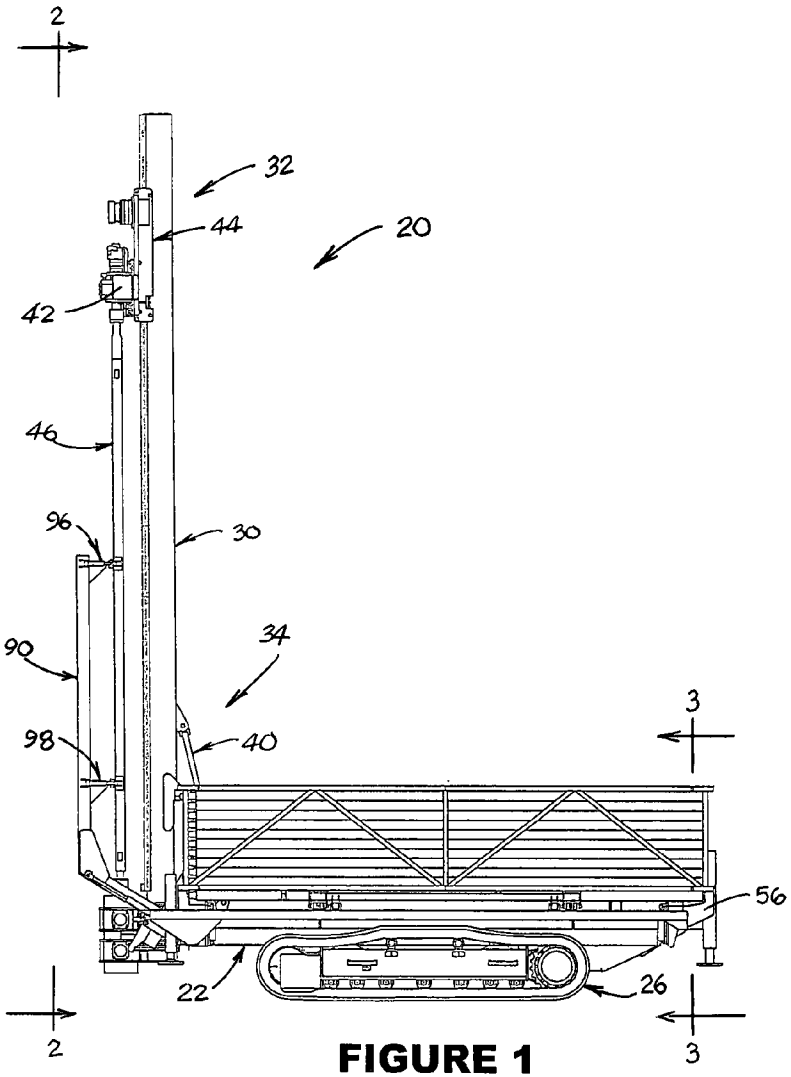
FIG. 1 is a side view of a drilling machine which includes a preferred embodiment of the claimed assembly for handling drill pipes.

Drilling machine 20, which is adapted for drilling a well or other borehole, is illustrated in the drawings. Drilling machine 20 includes frame 22 having substantially horizontal deck 24 (best shown in FIGS. 9-11), and a drive assembly including an engine (not shown) which is adapted to drive paired ground-engaging track assemblies 26. Operator's station 28 is provided at one end of the machine (best shown in FIGS. 5 and 7) for use by an operator in controlling the operation of the machine. Drilling machine 20 includes mast 30 having upper end 32 and lower end 34. As best shown in FIGS. 5, 7, 9 and 11, the lower end of mast 30 is mounted so as to pivot about pivot 36, supported by pivot support 38, on frame 22 so that the mast is moveable between a travel position (not shown) and a plurality of drilling positions (including the substantially vertical drilling position shown in the drawings). Linear actuator 40 may be actuated to move the mast between the travel position and the drilling positions.

Figure 11:
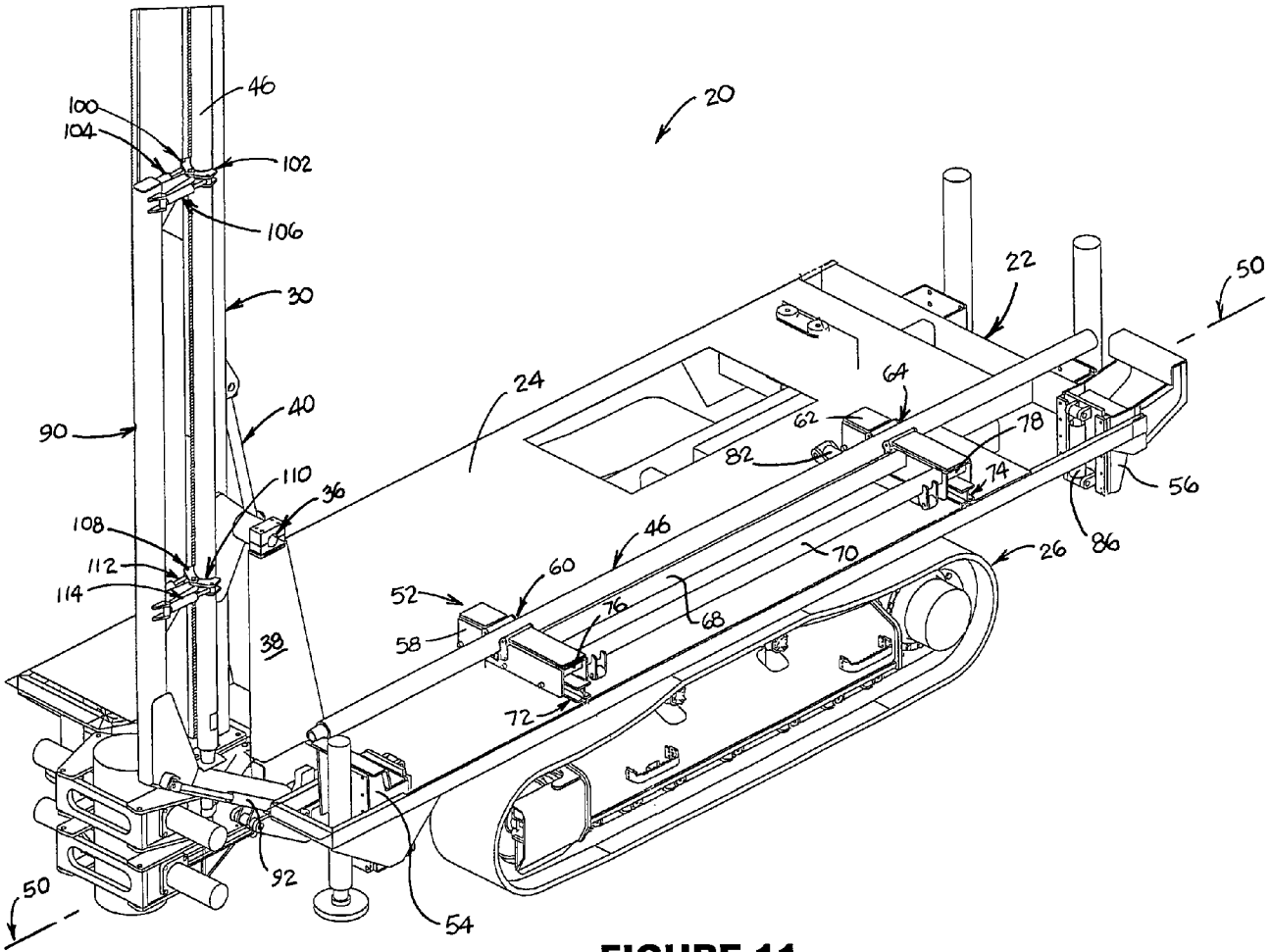
FIG. 11 is a perspective view of a portion of a drilling machine such as is illustrated in FIGS. 9 and 10, which drilling machine does not include a drill pipe attached to the drill head.

Mounted on mast 30 is drill head 42 that is adapted to move in two ways with respect to the mast. Preferably, as shown in FIGS. 1 and 11, drill head 42 is mounted on carriage 44, which is adapted to move along the mast between an upper position at the upper end of the mast (shown in the drawings) and a lower position at the lower end of the mast (not shown). Preferably, as is known to those having ordinary skill in the art to which the invention relates, the carriage includes a pair of drive motors having pinions mounted thereon, each of which is adapted to engage a rack on opposite sides of the mast. The drill head also includes a motor that is adapted to rotate a drill string in a manner known to those having ordinary skill in the appropriate art. When the drilling machine is engaged in drilling a hole, the drill head rotates a rotary bit (not shown) that is carried on the lower end of a drill string comprised of a number of drill pipes 46 that are joined together, usually by threaded engagement, as the carriage drives the drill head from the upper end of the mast towards the lower end. If the drill string is comprised of tubular drill pipes (which is common), a mud slurry may be pumped downwardly through the drill string in order to carry cuttings from the drill bit upwardly around the pipe surface and out of the drill hole. When the drill head reaches the lower position on the mast, i.e. when the drill string has been driven all the way (or almost all the way) into the ground, the drill head is disconnected from the drill string in a manner known to those having ordinary skill in the art to which the invention relates. Then the drill head is raised to the upper end of the mast and readied to receive an additional drill pipe to be added to the drill string. In order to accomplish this, drill head 42 is also adapted to move laterally between a drilling position that is aligned with the mast (not shown) and a laterally displaced drill string assembly/disassembly position (best shown in FIG. 2). Preferably, this is accomplished by means of a linear actuator (not shown). Drill head 42 is adapted to attach a drill pipe to the drill string and to remove a drill pipe from the drill string, in a manner known to those having ordinary skill in the art to which the invention relates.

Figure 3:
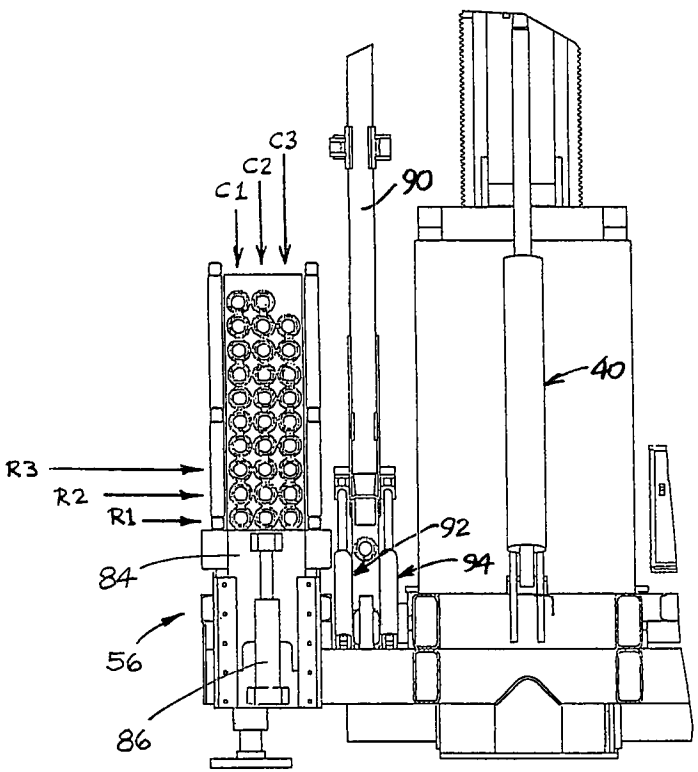
FIG. 3 is a partial sectional view of a portion of the drilling machine illustrated in FIGS. 1 and 2, taken along the line 3-3 of FIG. 1, showing a drill pipe support in an elevated position.
Figure 5:
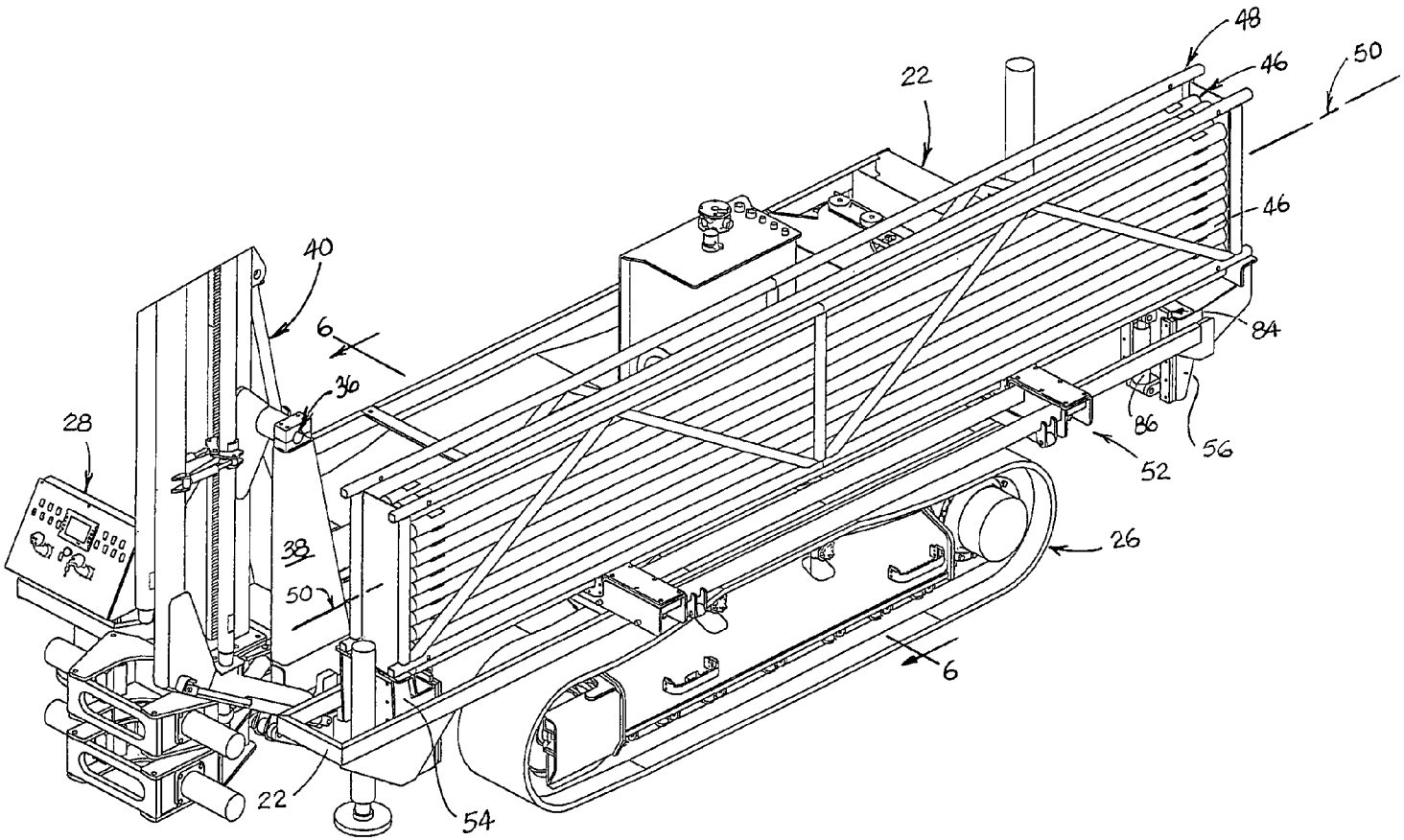
FIG. 5 is a perspective view of the drilling machine illustrated in FIGS. 1 and 2, but showing only a portion of the mast and loader arm assembly, and showing the support table of the claimed assembly in a column alignment position.
Figure 6:
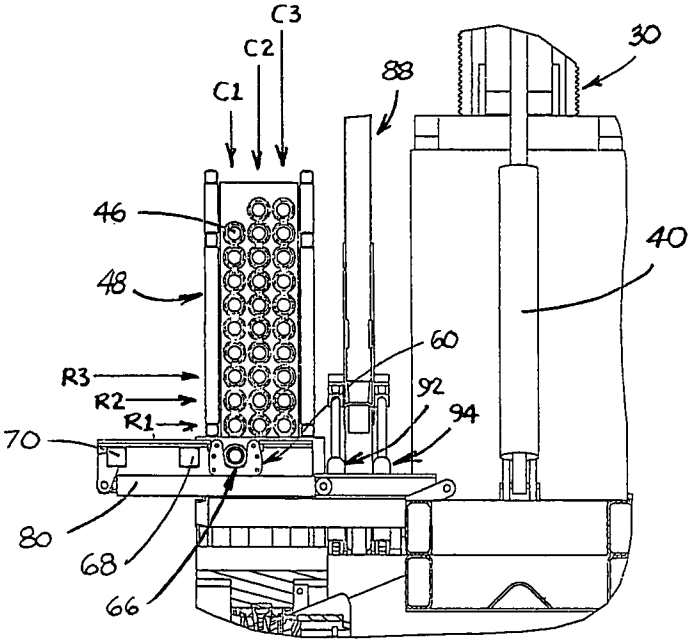
FIG. 6 is a partial sectional view of a portion of the drilling machine illustrated in FIG. 5, taken along the line 6-6 of FIG. 5, showing the support table in a column alignment position.

Drilling machine 20 also includes an assembly for handling drill pipes, which assembly includes drill pipe basket 48. Drill pipe basket 48 is adapted to contain a plurality of drill pipes 46 in a plurality of rows and a plurality of columns. Thus, for example, as shown in FIGS. 3 and 6, drill pipe basket 48 includes a plurality of drill pipes 46 arranged in three columns C1, C2 and C3, and ten rows, the bottom three of which are labeled R1, R2 and R3. The drill pipe basket has long axis 50 (shown in FIGS. 5 and 11), which is parallel to the long axis of each drill pipe in the drill pipe basket.

Figure 8:
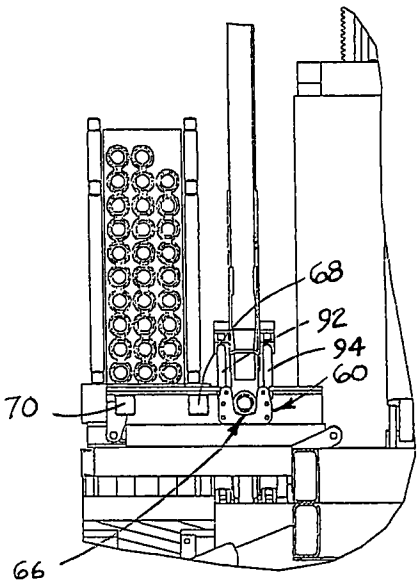
FIG. 8 is a partial sectional view of a portion of the drilling machine illustrated in FIG. 7, taken along line 8-8 of FIG. 7, showing the support table in an extended position.

The preferred assembly for handling drill pipes of drilling machine 20 includes a table assembly 52 and a pair of drill pipe elevator assemblies 54 and 56. Preferred table assembly 52 (best shown in FIG. 11) that is mounted on deck 24 beneath the drill pipe basket. Table assembly 52 comprises first support table 58 which includes first drill pipe receiver 60, and second support table 62 which includes second drill pipe receiver 64. Drill pipe receivers 60 and 64 are adapted to receive a drill pipe 46, and each drill pipe receiver has a receiver bottom (only one of which, receiver bottom 66 of first drill pipe receiver 60, is shown in FIGS. 6 and 8) on which the drill pipe rests when received in the receiver. First support table 58 and second support table 62 are joined together by table ties 68 and 70 (best shown in FIG. 11). As best shown in FIG. 11, table assembly 52 also includes first table guide 72 and second table guide 74, each of which is mounted on deck 24 perpendicular to long axis 50 of drill pipe basket 48 (not shown in FIG. 11). First support table 58 is mounted on the first table guide and second support table 62 is mounted on the second table guide. Preferably, the first and second support tables are adapted to move with respect to their respective table guides by means of a plurality of rollers, including roller 76 and roller 78. In the alternative, ultra high molecular weight polyethylene slides, or other means known to those having ordinary skill in the art to which the invention relates, may be employed to allow the support tables to move along and with respect to the table guides. In the preferred embodiment of the invention illustrated in the drawings, a pair of linear actuators 80 and 82 are provided, one for each support table. One end of each linear actuator is attached to the deck adjacent to the end of its associated support table nearest the center of drilling machine 20, and the other end is attached to tie 70. By simultaneously actuating linear actuators 80 and 82, the support tables may move laterally simultaneously with respect to the drill pipe basket between a plurality of column alignment positions, each of which locates the first drill pipe receiver and the second drill pipe receiver beneath a column of the drill pipe basket (best shown in FIGS. 5 and 6), and an external position which locates the first drill pipe receiver and the second drill pipe receiver laterally outside of the drill pipe basket (best shown in FIGS. 7 and 8).

As mentioned above, the preferred assembly for handling drill pipes of drilling machine 20 includes a pair of essentially-identical drill pipe elevator assemblies 54 and 56, one at each end of the drill pipe basket. Preferred drill pipe elevator assembly 56 (best shown in FIGS. 3 and 4) includes a drill pipe support in the form of end plate 84 that is adapted to support the drill pipes in the drill pipe basket, and linear actuator 86 that is adapted to move the drill pipe support between an elevated position (shown in FIG. 3) that is at or above support table 52 and a lowered position (shown in FIG. 4) that is at or below the bottom of the drill pipe receivers.

Figure 10:
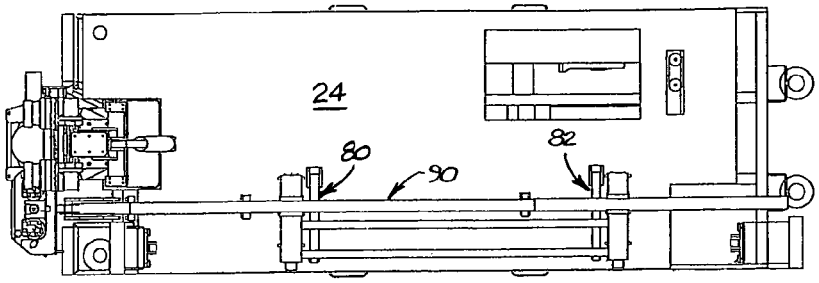
FIG. 10 is a top view of the portion of the drilling machine illustrated in FIG. 9.
Figure 9:
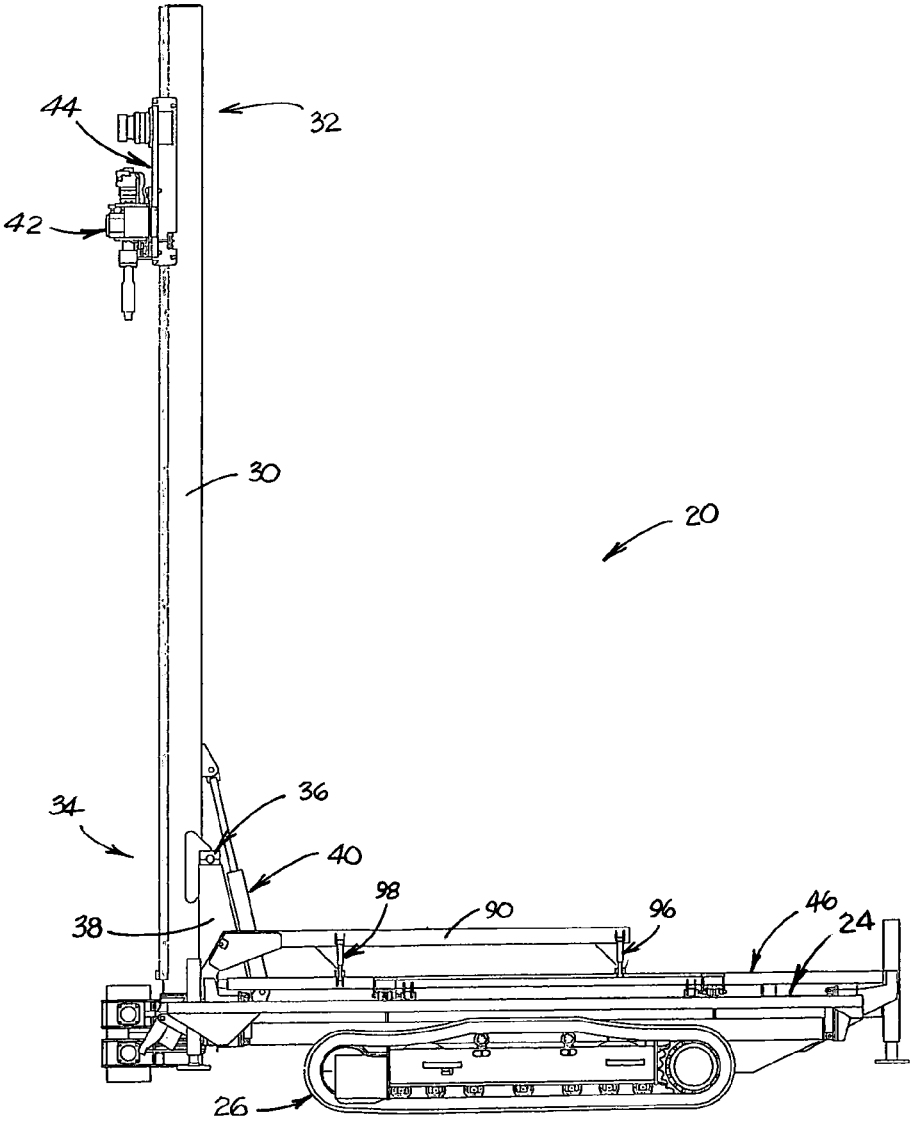
FIG. 9 is a side view of a drilling machine such as is illustrated in FIGS. 1-8, but with certain components, including the drill pipe basket, omitted for clarity.

The preferred assembly for handling drill pipes of drilling machine 20 also includes loader arm assembly 88 comprising loader arm 90 that is mounted so as to be moveable between a drilling alignment position (shown in FIGS. 1 and 2) and a table alignment position (shown in FIGS. 9 and 10). A pair of linear actuators 92 and 94 (shown in FIGS. 3, 4, 6 and 8) are provided for moving the loader arm between the drilling alignment position (FIGS. 1 and 2), in which the pipe gripper may grab or release a drill pipe when the mast is in the drilling position and the drill head is in the laterally displaced drill string assembly/disassembly position, and the table alignment position (FIGS. 9 and 10), in which the pipe gripper may grab or release a drill pipe when support table 52 is in the external position.

Figure 2:
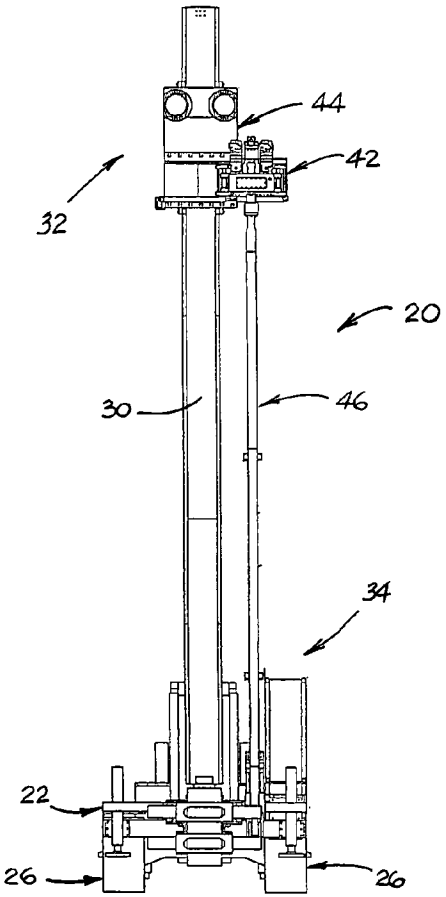
FIG. 2 is an end view of the drilling machine shown in FIG. 1, taken along the line 2-2 of FIG. 1.

When loader arm 90 is in the drilling alignment position, it is aligned with drill head 42 when mast 30 is in the drilling position and the drill head is in the laterally displaced drill string position (best shown in FIG. 2). Preferred loader arm 90 includes upper pipe gripper 96 and lower pipe gripper 98 (FIGS. 1 and 9), each of which may be simultaneously activated to grab a drill pipe, and each of which may be simultaneously deactivated to release a drill pipe.

Preferred upper pipe gripper 96 further comprises left upper gripper 100 (comprised of two parallel plates) and right upper gripper 102 (also comprised of two parallel plates). Attached between the loader arm and left upper gripper 100 is left upper gripper linear actuator 104, which is adapted for extension and retraction. Similarly, right upper gripper linear actuator 106 is attached between loader arm 90 and right upper gripper 102, and is also adapted for extension and retraction. Furthermore, left upper gripper 100 is pivotally attached to right upper gripper 102 so that simultaneous extension of left upper gripper linear actuator 104 and right upper gripper linear actuator 106 will close upper pipe gripper 96, and so that simultaneous retraction of left upper gripper linear actuator 104 and right upper gripper linear actuator 106 will open the upper pipe gripper.

Preferred lower pipe gripper 98 comprises left lower gripper 108 (comprised of two parallel plates) and right lower gripper 110 (also comprised of two parallel plates). Left lower gripper linear actuator 112 is attached between loader arm 90 and left lower gripper 108, and is adapted for extension and retraction. Similarly, right lower gripper linear actuator 114 is attached between the loader arm and right lower gripper 110, and is adapted for extension and retraction. Furthermore, left lower gripper 108 is pivotally attached to right lower gripper 110 so that simultaneous extension of the left lower gripper linear actuator and the right lower gripper linear actuator will close lower pipe gripper 98, and so that simultaneous retraction of the left lower gripper linear actuator and the right lower gripper linear actuator will open the lower pipe gripper.

In order to add a drill pipe to a drill string when drill head 42 has been advanced to the lower position on mast 30, the drill head is moved to the upper position on the mast and to the laterally displaced drill string assembly/disassembly position shown in FIG. 2. Then the operator may use the drill pipe handling assembly to grab a drill pipe from drill pipe basket 48 by actuating the linear actuators in drill pipe elevator assemblies 54 and 56 to move the drill pipe supports to an elevated position that is at or above support table 52, as shown in FIG. 3. Then the operator may select a column in the drill pipe basket from which to remove a drill pipe and actuate linear actuators 80 and 82 to move support tables 58 and 62 to alignment positions that locate the drill pipe receivers beneath the selected column of the drill pipe basket, such as, for example, beneath column C1 of drill pipe basket 48, as shown in FIG. 6. Alternatively (although not shown in the drawings), the support tables could be moved to alignment positions with column C2 or to alignment positions with column C3 (or to alignment positions with other columns if the drill pipe basket accommodates drill pipes in more than three columns). This feature distinguishes the invention from the pipe handling assembly of the '927 patent, which is adapted to remove a drill pipe only from the center column in a three-column storage basket. However, because the invention permits an operator to select any column from the drill pipe basket, it can be employed to cycle through all of the drill pipes, avoiding uneven or unequal wear on some of the drill pipes.

Figure 4:
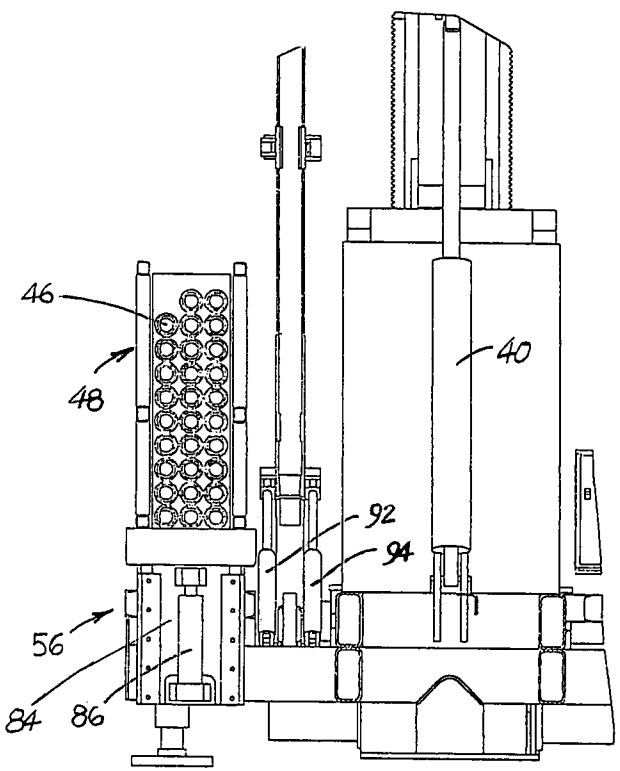
FIG. 4 is a view similar to that of FIG. 3, showing a drill pipe support in a lowered position.
Figure 7:
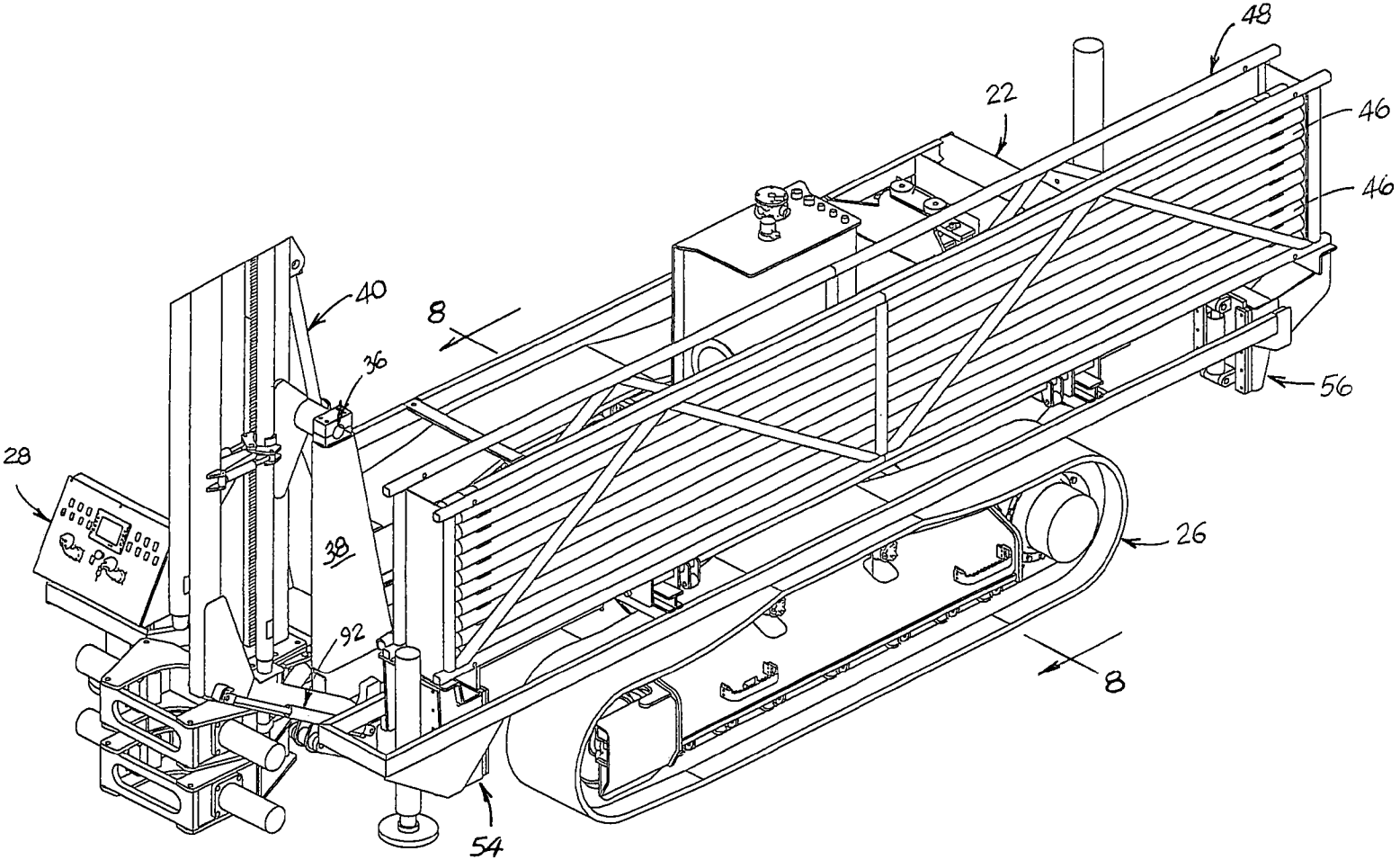
FIG. 7 is a perspective view of the drilling machine illustrated in FIGS. 1 and 2, but showing only a portion of the mast and loader arm assembly, and showing the support table of the claimed assembly in an extended position.

When the support tables are moved to column alignment positions beneath a selected column of a drill pipe basket having a plurality of drill pipes therein, the operator may actuate the linear actuators in the drill pipe elevator assemblies to move the drill pipe supports to a lowered position that is at or below the bottom of the drill pipe receivers, such as is shown in FIG. 4. This action places the drill pipe in the lowest row of the selected column in the drill pipe receivers (including drill pipe receiver 66 shown in FIG. 6). As this occurs, all remaining drill pipes in the selected and aligned column will move downwardly within the selected column, so that, for example, the drill pipe originally in row R2 in column C1 will drop to row R1 and the drill pipe originally in row R3 in column C1 will drop to row R2. Furthermore, the drill pipes in the columns not selected will be supported by the drill pipe supports of the drill pipe elevator assemblies, as well as by the support tables of the table assembly. Then with a drill pipe in the drill pipe receivers of the table assembly, the operator may actuate linear actuators 80 and 82 to move the support tables to external positions that locate the drill pipe receivers laterally outside of the drill pipe basket, as shown in FIGS. 7 and 8. When the selected drill pipe in the drill pipe receivers has been moved outside of the drill pipe basket, the operator may actuate linear actuators 92 and 94 to move the loader arm to the table alignment position shown in FIGS. 9 and 10. The operator may also actuate linear actuators 104 and 106 of upper pipe gripper 96 and linear actuators 112 and 114 of lower pipe gripper 98 to open to receive a drill pipe and to close to grab the drill pipe. Then, with the drill pipe firmly in the grip of the loader arm assembly, the operator may actuate linear actuators 92 and 94 to move the loader arm from the table alignment position to a drilling alignment position. Drill head 42 may then be employed, in a manner known to those having ordinary skill in the art to which the invention relates, to incorporate the drill pipe into the drill string. When it is desired to break down the drill string, the steps outlined above may be reversed to remove a drill pipe from the drill string and replace it in drill pipe basket 48.

Although this description contains many specifics, these should not be construed as limiting the scope of the invention, but as merely providing illustrations of some of the presently preferred embodiments thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. An assembly for handling drill pipes which are adapted to be joined together in a drill string, said assembly comprising:

(a) a drill pipe basket which is adapted to contain a plurality of drill pipes that are arranged in a plurality of rows and a plurality of columns;

(b) a table assembly that is disposed beneath the drill pipe basket, said table assembly comprising:

(i) a support table having a drill pipe receiver that is adapted to receive a drill pipe and includes a receiver bottom, said support table being adapted to move laterally with respect to the drill pipe basket between a plurality of column alignment positions, each of which locates the drill pipe receiver beneath a column of the drill pipe basket, and an external position which locates the drill pipe receiver laterally outside of the drill pipe basket;

(ii) means for moving the support table between the plurality of column alignment positions and the external position;

(c) a drill pipe elevator assembly comprising:

(i) a drill pipe support that is adapted to support the drill pipes in the drill pipe basket;

(ii) means for moving the drill pipe support between an elevated position that is at or above the support table and a lowered position that is at or below the bottom of the drill pipe receiver;

(d) a loader arm assembly comprising:

(i) a loader arm having a pipe gripper that is adapted to grab and release a drill pipe;

(A) when the loader arm is in a table alignment position and the support table is in the external position; and (B) when the loader arm is in a plurality of drilling alignment positions;

(ii) means for moving the loader arm between the table alignment position and the plurality of drilling alignment positions, including a vertical drilling alignment position.

2. The assembly of claim 1 wherein the loader arm is in a substantially horizontal position when in the table alignment position.

3. The assembly of claim 1 wherein:

(a) the drill pipe basket has a long axis;

(b) the table assembly includes a table guide which is mounted perpendicular to the long axis of the drill pipe basket;

(c) the support table is mounted on the table guide and adapted to move with respect thereto between the plurality of column alignment positions and the external position.

4. The assembly of claim 1 wherein the means for moving the support table between the plurality of column alignment positions and the external position comprises a linear actuator.

5. The assembly of claim 1 wherein the means for moving the drill pipe support between the elevated position and the lowered position comprises a linear actuator.

6. The assembly of claim 1 wherein the means for moving the loader arm between the table alignment position and the plurality of drilling alignment positions comprises a linear actuator.

7. The assembly of claim 1 wherein the table assembly comprises:

(a) a first support table having a first drill pipe receiver that includes a first receiver bottom and a second support table having a second drill pipe receiver that includes a second receiver bottom, wherein the first support table and the second support table are adapted to:

(i) receive a drill pipe; and (ii) move laterally simultaneously with respect to the drill pipe basket between the plurality of column alignment positions, each of which locates the first drill pipe receiver and the second drill pipe receiver beneath a column of the drill pipe basket, and the external position which locates the first drill pipe receiver and the second drill pipe receiver laterally outside of the drill pipe basket;

(b) means for simultaneously moving the first support table and the second support table between the plurality of column alignment positions and the external position.

8. The assembly of claim 7 wherein (a) the drill pipe basket has a long axis;

(b) the table assembly comprises a first table guide and a second table guide, each of which is mounted substantially perpendicular to the long axis of the drill pipe basket;

(c) the first support table is mounted on the first table guide and adapted to move with respect thereto between the plurality of column alignment positions and the external position;

(d) the second support table is mounted on the second table guide and adapted to move with respect thereto between the plurality of column alignment positions and the external position;

(e) the means for simultaneously moving the first support table and the second support table between the plurality of column alignment positions and the external position comprises a first support table linear actuator and a second support table linear actuator.

9. The assembly of claim 1 wherein the drill pipe elevator assembly comprises:

(a) a first drill pipe support and a second drill pipe support, each of which is adapted to support the drill pipes in the drill pipe basket;

(b) means for simultaneously moving the first drill pipe support and the second drill pipe support between the elevated position and the lowered position.

10. The assembly of claim 9 wherein the means for simultaneously moving the first drill pipe support and the second drill pipe support between the elevated position and the lowered position comprises a first drill pipe support linear actuator and a second drill pipe support linear actuator.

11. The assembly of claim 1 wherein the loader arm assembly comprises an upper pipe gripper and a lower pipe gripper, each of which may be simultaneously actuated to grab a drill pipe, and each of which may be simultaneously actuated to release a drill pipe.

12. An assembly for handling drill pipes which are adapted to be joined together in a drill string, said assembly comprising:

(a) a drill pipe basket which is adapted to contain a plurality of drill pipes that are arranged in a plurality of rows and a plurality of columns;

(b) a table assembly that is disposed beneath the drill pipe basket, said table assembly comprising:

(i) a support table having a drill pipe receiver that is adapted to receive a drill pipe and includes a receiver bottom, said support table being adapted to move laterally with respect to the drill pipe basket between a plurality of column alignment positions, each of which locates the drill pipe receiver beneath a column of the drill pipe basket, and an external position which locates the drill pipe receiver laterally outside of the drill pipe basket;

(ii) means for moving the support table between the plurality of column alignment positions and the external position;

(c) a drill pipe elevator assembly comprising:

(i) a drill pipe support that is adapted to support the drill pipes in the drill pipe basket;

(ii) means for moving the drill pipe support between an elevated position that is at or above the support table and a lowered position that is at or below the bottom of the drill pipe receiver;

(d) a loader arm assembly comprising:

(i) a loader arm having:

(A) an upper pipe gripper which comprises:

(1) a left upper gripper;

(2) a right upper gripper;

(3) a left upper gripper linear actuator that is attached between the loader arm and the left upper gripper, said left upper gripper linear actuator being adapted for extension and retraction;

(4) a right upper gripper linear actuator that is attached between the loader arm and the right upper gripper, said right upper gripper linear actuator being adapted for extension and retraction;

wherein the left upper gripper is pivotally attached to right upper gripper so that simultaneous extension of the left upper gripper linear actuator and the right upper gripper linear actuator will close the upper pipe gripper, and so that simultaneous retraction of the left upper gripper linear actuator and the right upper gripper linear actuator will open the upper pipe gripper;

(B) a lower pipe gripper which comprises:

(1) a left lower gripper;

(2) a right lower gripper;

(3) a left lower gripper linear actuator that is attached between the loader arm and the left lower gripper, said left lower gripper linear actuator being adapted for extension and retraction;

(4) a right lower gripper linear actuator that is attached between the loader arm and the right lower gripper, said right lower gripper linear actuator being adapted for extension and retraction;

wherein the left lower gripper is pivotally attached to right lower gripper so that simultaneous extension of the left lower gripper linear actuator and the right lower gripper linear actuator will close the lower pipe gripper, and so that simultaneous retraction of the left lower gripper linear actuator and the right lower gripper linear actuator will open the lower pipe gripper;

(ii) means for moving the loader arm between a table alignment position when the support table is in the external position and a drilling alignment position.

13. A drilling machine for drilling using a plurality of drill pipes which are adapted to be joined together in a drill string, said drilling machine comprising:

(a) a frame having a substantially horizontal deck;

(b) a mast having an upper end and a lower end, said mast being pivotally mounted on the frame so that it is moveable between a travel position and a plurality of drilling positions;

(c) a drill head that is:

(i) mounted on the mast;

(ii) adapted to move between a drilling position that is aligned with the mast and a laterally displaced drill string assembly/disassembly position;

(iii) adapted to move along the mast between an upper position at the upper end of the mast and a lower position at the lower end of the mast;

(iv) adapted to attach a drill pipe to the drill string and to remove a drill pipe from the drill string;

(d) a drill pipe basket which is adapted to contain a plurality of drill pipes in a plurality of rows and a plurality of columns;

(e) a table assembly that is mounted on the deck beneath the drill pipe basket, said table assembly comprising:

(i) a support table having a drill pipe receiver that is adapted to receive a drill pipe and includes a receiver bottom, said support table being adapted to move laterally with respect to the drill pipe basket between a plurality of column alignment positions, each of which locates the drill pipe receiver beneath a column of the drill pipe basket, and an external position which locates the drill pipe receiver laterally outside of the drill pipe basket;

(ii) means for moving the support table between the plurality of column alignment positions and the external position;

(f) a drill pipe elevator assembly comprising:

(i) a drill pipe support that is adapted to support the drill pipes in the drill pipe basket;

(ii) means for moving the drill pipe support between an elevated position that is at or above the support table and a lowered position that is at or below the bottom of the drill pipe receiver;

(g) a loader arm assembly comprising:

(i) a loader arm having a pipe gripper that is adapted to grab and release a drill pipe:

(A) when the loader arm is in a table alignment position and the support table is in the external position; and (B) when the loader arm is in a drilling alignment position;

(ii) means for moving the loader arm between the table alignment position when the support table is in the external position and the drilling alignment position when the mast is in one of the drilling positions and the drill head is in the laterally displaced drill string assembly/disassembly position.

14. The drilling machine of claim 13 wherein the loader arm is mounted so as to be moveable between the table alignment position and a plurality of drilling alignment positions, each of which drilling alignment positions aligns with the drill head when the mast is in one of the drilling positions and the drill head is in the laterally displaced drill string assembly/disassembly position.

15. The drilling machine of claim 13 wherein:

(a) the drill pipe basket has a long axis;

(b) the table assembly includes a table guide which is mounted on the deck substantially perpendicular to the long axis of the drill pipe basket;

(c) the support table is mounted on the table guide and adapted to move with respect thereto between the plurality of column alignment positions and the external position.

16. The drilling machine of claim 13 wherein the table assembly comprises:

(a) a first support table having a first drill pipe receiver that includes a first receiver bottom and a second support table having a second drill pipe receiver that includes a second receiver bottom, wherein the first support table and the second support table are adapted to:

(i) receive a drill pipe; and (ii) move laterally simultaneously with respect to the drill pipe basket between the plurality of column alignment positions, each of which locates the first drill pipe receiver and the second drill pipe receiver beneath a column of the drill pipe basket, and the external position which locates the first drill pipe receiver and the second drill pipe receiver laterally outside of the drill pipe basket;

(b) means for simultaneously moving the first support table and the second support table between the plurality of column alignment positions and the external position.

17. The drilling machine of claim 16 wherein (a) the drill pipe basket has a long axis;

(b) the table assembly comprises a first table guide and a second table guide, each of which is mounted on the deck perpendicular to the long axis of the drill pipe basket;

(c) the first support table is mounted on the first table guide and adapted to move with respect thereto between the plurality of column alignment positions and the external position;

(d) the second support table is mounted on the second table guide and adapted to move with respect thereto between the plurality of column alignment positions and the external position.

18. The drilling machine of claim 13 wherein the drill pipe elevator assembly comprises:

(a) a first drill pipe support and a second drill pipe support, each of which is adapted to support the drill pipes in the drill pipe basket;

(b) means for simultaneously moving the first drill pipe support and the second drill pipe support between the elevated position and the lowered position.

19. The drilling machine of claim 13 wherein the loader arm assembly comprises an upper pipe gripper and a lower pipe gripper, said loader arm assembly being adapted to grab a drill pipe, and to release a drill pipe.

20. A drilling machine for drilling using a plurality of drill pipes which are adapted to be joined together in a drill string, said drilling machine comprising:

(a) a frame having a substantially horizontal deck;

(b) a mast having an upper end and a lower end, said mast being pivotally mounted on the frame so that it is moveable between a travel position and a plurality of drilling positions;

(c) a drill head that is:

(i) mounted on the mast;

(ii) adapted to move between a drilling position that is aligned with the mast and a laterally displaced drill string assembly/disassembly position;

(iii) adapted to move along the mast between an upper position at the upper end of the mast and a lower position at the lower end of the mast;

(iv) adapted to attach a drill pipe to the drill string and to remove a drill pipe from the drill string;

(d) a drill pipe basket which is adapted to contain a plurality of drill pipes in a plurality of rows and a plurality of columns;

(e) a table assembly that is mounted on the deck beneath the drill pipe basket, said table assembly comprising:

(i) a support table having a drill pipe receiver that is adapted to receive a drill pipe and includes a receiver bottom, said support table being adapted to move laterally with respect to the drill pipe basket between a plurality of column alignment positions, each of which locates the drill pipe receiver beneath a column of the drill pipe basket, and an external position which locates the drill pipe receiver laterally outside of the drill pipe basket;

(ii) means for moving the support table between the plurality of column alignment positions and the external position;

(f) a drill pipe elevator assembly comprising:

(i) a drill pipe support that is adapted to support the drill pipes in the drill pipe basket;

(ii) means for moving the drill pipe support between an elevated position that is at or above the support table and a lowered position that is at or below the bottom of the drill pipe receiver;

(g) a loader arm assembly comprising:

(h) an upper pipe gripper which comprises:

(i) a left upper gripper;

(ii) a right upper gripper;

(iii) a left upper gripper linear actuator that is attached between the loader arm and the left upper gripper, said left upper gripper linear actuator being adapted for extension and retraction;

(iv) a right upper gripper linear actuator that is attached between the loader arm and the right upper gripper, said right upper gripper linear actuator being adapted for extension and retraction;

wherein the left upper gripper is pivotally attached to right upper gripper so that simultaneous extension of the left upper gripper linear actuator and the right upper gripper linear actuator will close the upper pipe gripper, and so that simultaneous retraction of the left upper gripper linear actuator and the right upper gripper linear actuator will open the upper pipe gripper;

(i) a lower pipe gripper which comprises:

(i) a left lower gripper;

(ii) a right lower gripper;

(iii) a left lower gripper linear actuator that is attached between the loader arm and the left lower gripper, said left lower gripper linear actuator being adapted for extension and retraction;

(iv) a right lower gripper linear actuator that is attached between the loader arm and the right lower gripper, said right lower gripper linear actuator being adapted for extension and retraction;

wherein the left lower gripper is pivotally attached to right lower gripper so that simultaneous extension of the left lower gripper linear actuator and the right lower gripper linear actuator will close the lower pipe gripper, and so that simultaneous retraction of the left lower gripper linear actuator and the right lower gripper linear actuator will open the lower pipe gripper.

* * * * *